US005813811A

United States Patent [19]

Saunders

[11] Patent Number: 5,813,811

[45] Date of Patent: Sep. 29, 1998

[54] EASY-ACCESS SHEET METAL CONTAINER STRUCTURES

[75] Inventor: William T. Saunders, deceased, late of Weirton, W. Va., by Cleo M. Saunders, executrix

[73] Assignee: Weirton Steel Corporation, Weirton, W. Va.

[21] Appl. No.: 753,269

[22] Filed: Nov. 22, 1996

Related U.S. Application Data

[62] Division of Ser. No. 99,195, Jul. 29, 1993.

[51] Int. Cl.[6] ..... B21D 51/44

[52] U.S. Cl. ..... 413/16; 413/12; 413/13; 413/14; 413/15; 413/17; 413/66; 413/67; 428/595; 428/603; 72/348; 220/269

[58] Field of Search ..... 413/12–17, 66, 413/67; 72/348; 220/269; 428/595, 603, 34.1

[56] References Cited

U.S. PATENT DOCUMENTS 4,096,967 6/1978 Kaminski ..... 220/269
4,530,631 7/1985 Kaminski et al. ..... 413/12
4,576,305 3/1986 Saunders ..... 220/269

*Primary Examiner*—Shelley A. Dodson
*Assistant Examiner*—Michael A. Williamson
*Attorney, Agent, or Firm*—Shanley and Baker

[57] ABSTRACT

Scoreline, profiling and reinforcing features are provided for an easy-access sheet metal end closure (20) and an integral opener (44). An endwall panel (28) is formed so as to substantially eliminate flexing of the sheet metal during rupture of residual metal of scoreline means defining a U-shaped tear strip (30). Such tear strip is oriented with its arcuately-shaped closed end (32) contiguous to the periphery of such endwall panel -with scoreline legs (34, 35) directed toward a portion at its geometric center (26). The opener is fabricated with a chisel-point (92) at its working end (66) to initiate puncture of such arcuate-shaped scoreline by Class I lever action. Rupturing of the scoreline is followed by pivoting of the opener about a pair of fulcrum points, (82, 83) which contact the panel one each external to a, side of opening 62, with movement of the opening about such fulcrum points rupturing the scoreline legs by Class; II lever action. The opener and tear strip are retained and stored externally on the panel without obstructing the opening (62).

8 Claims, 9 Drawing Sheets

FIG. 1
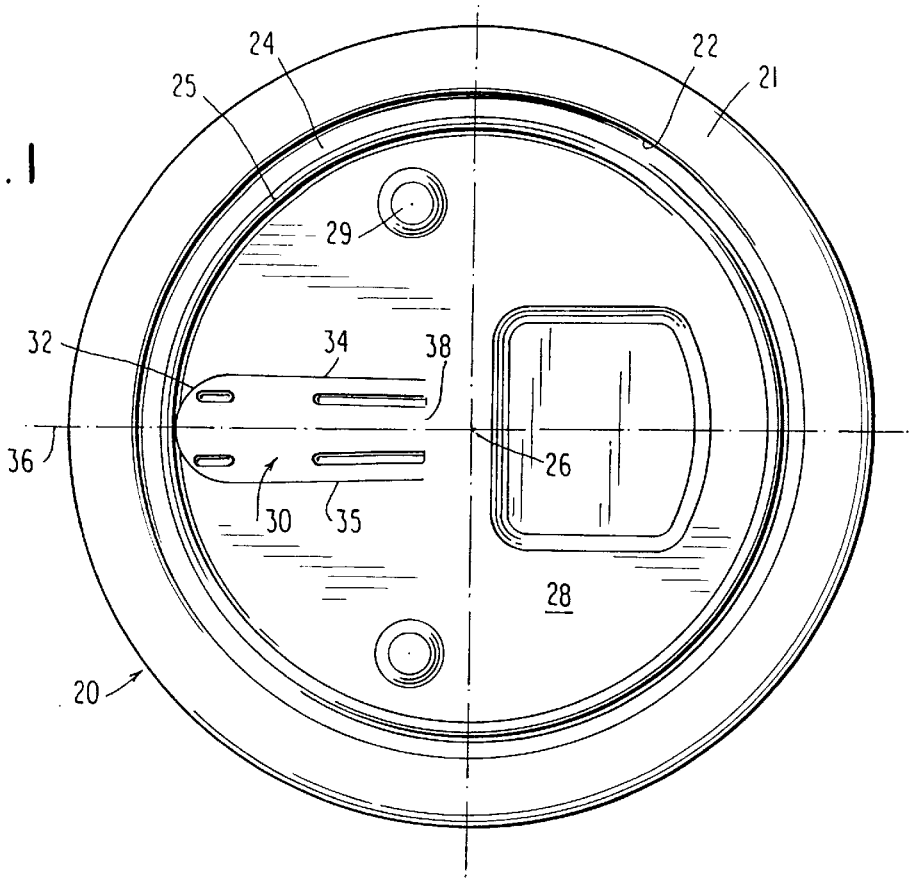
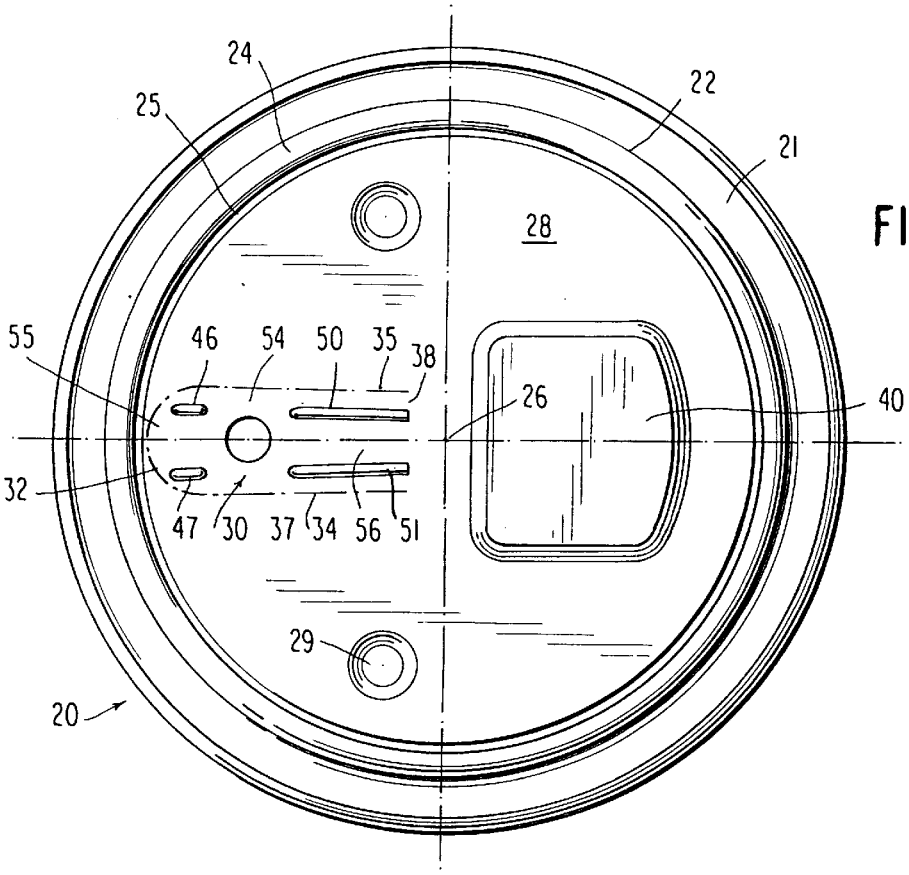
FIG. 2

EASY-ACCESS SHEET METAL CONTAINER STRUCTURES

This application is a division of application Ser. No. 08/099,195, filed Jul. 29, 1993.

This application is a division of copending application Ser. No. 08/099,195 entitled "Easy-Access Sheet Metal Container Structure" which is a continuation-in-part of application Ser. No. 07/824,780 filed Jan. 17, 1992, now abandoned, which was a division of application Ser. No. 07/454,361 filed Dec. 21, 1989, now abandoned.

This invention relates to easy-access sheet metal container structures, their fabrication and usage. In its more specific aspects, this invention is concerned with scoreline, profiling and reinforcing features for container endwall and integral opener structures, which facilitate both fabrication and functioning of such structures for purposes of severing scored sheet metal and movement of a resultant tear strip from the contour of the wall panel to form an opening for removal of container contents while retaining and storing the tear strip and opener externally of the container in a manner which does not obstruct the opening.

Prior art convenience-feature end closure structures for beverage cans, include:

(a) the early-developed ring-pull throw-away type in which a scored portion, near the geometric center of a sheet metal endwall panel, was initially ruptured by Class II lever action followed by separating the scored sheet metal tear strip and ring-pull handle entirely from the panel, (b) a "tape sealed" type in which metal foil laminated with adhesive covers a small pour opening in a sheet metal endwall of a can for non-carbonated beverages, such as tomato juice; and (c) a "retained tab" type for forming an opening by raising an integral opener to (i) rupture sheet metal near the geometric center of an endwall panel, (ii) to push the ruptured sheet metal into the interior of the container, and, then the integral opener is pulled backwardly toward the external surface at the container endwall panel opposite to the opening. The latter type is currently in general commercial use for sheet metal carbonated beverage cans.

Applicant's U.S. Pat. No. 4,576,305 initiated a differing approach for achieving "retained-tab" features on an easy-open end closure container structure. The present retained-tab end closure structures provide new configurations and dispositions for (a) sheet metal scorelines (b) end panel profiling, (c) sheet metal shaping and (d) types of integral sheet metal opener structures. Contributions of the present invention facilitate fabrication and functioning of end closure structures to provide better sanitary and tamper-resistant conditions for canned comestibles; and, better environmental conditions by enabling retention of both a sheet metal tear strip and integral opener in stored relationship out of contact with container contents by being stored on the exterior of the end closure structure at a location which does not interfere with pouring from or drinking through the opening.

Such advantages and contributions are considered in more detail in describing structures shown in the accompanying drawings; in such drawings:

FIG. 1 is a top plan view of the exterior side of an end closure structure showing the endwall panel while omitting an opener for better illustrating tear strip scoreline and profiling features of the invention;

FIG. 2 is a bottom plan view of the interior (or product) side of the end closure of the invention subsequent to forming a unitary rivet button for securing an integral opener to the tear strip;

Figure 3:
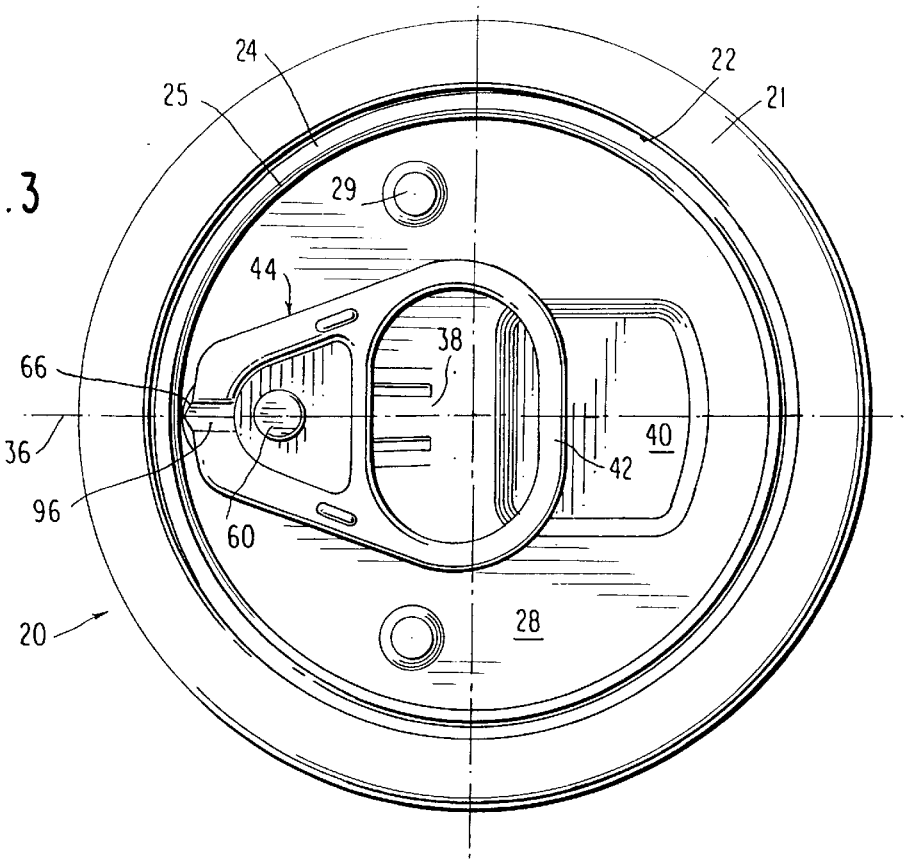
FIG. 3 is a top plan view of the embodiment of FIG. 2 with the new opener of the invention secured in place by a unitary rivet.
Figure 4:
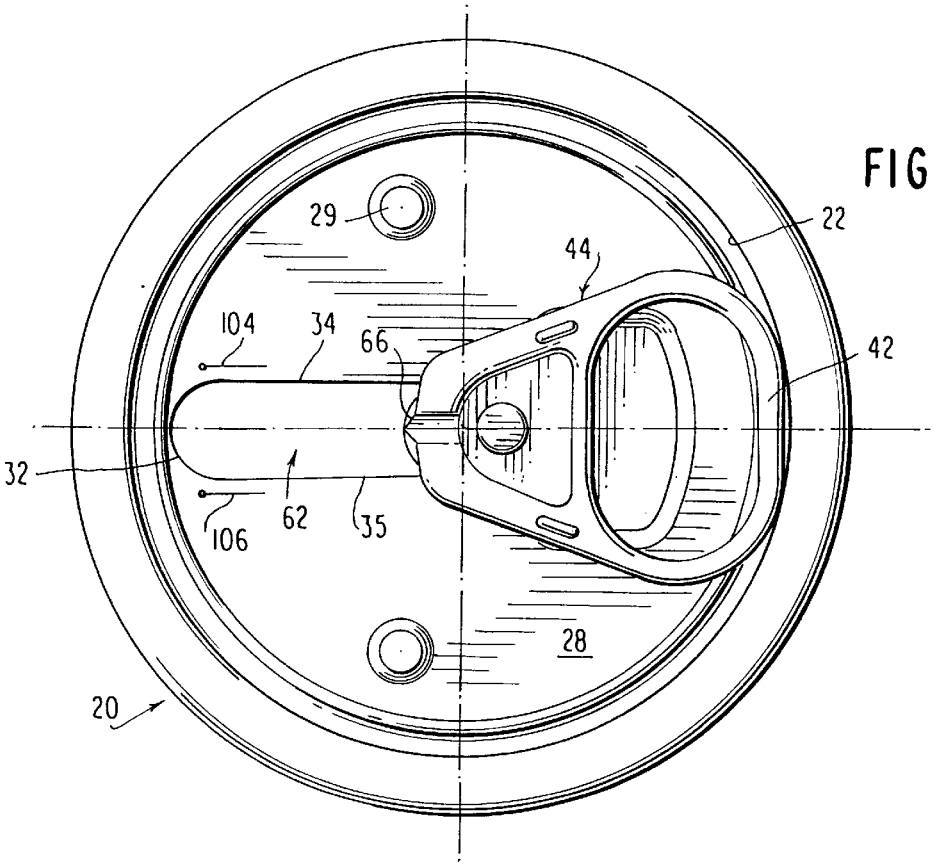
FIG. 4 is a top plan view, after opening, of the embodiment of FIG. 3.
Figure 5:
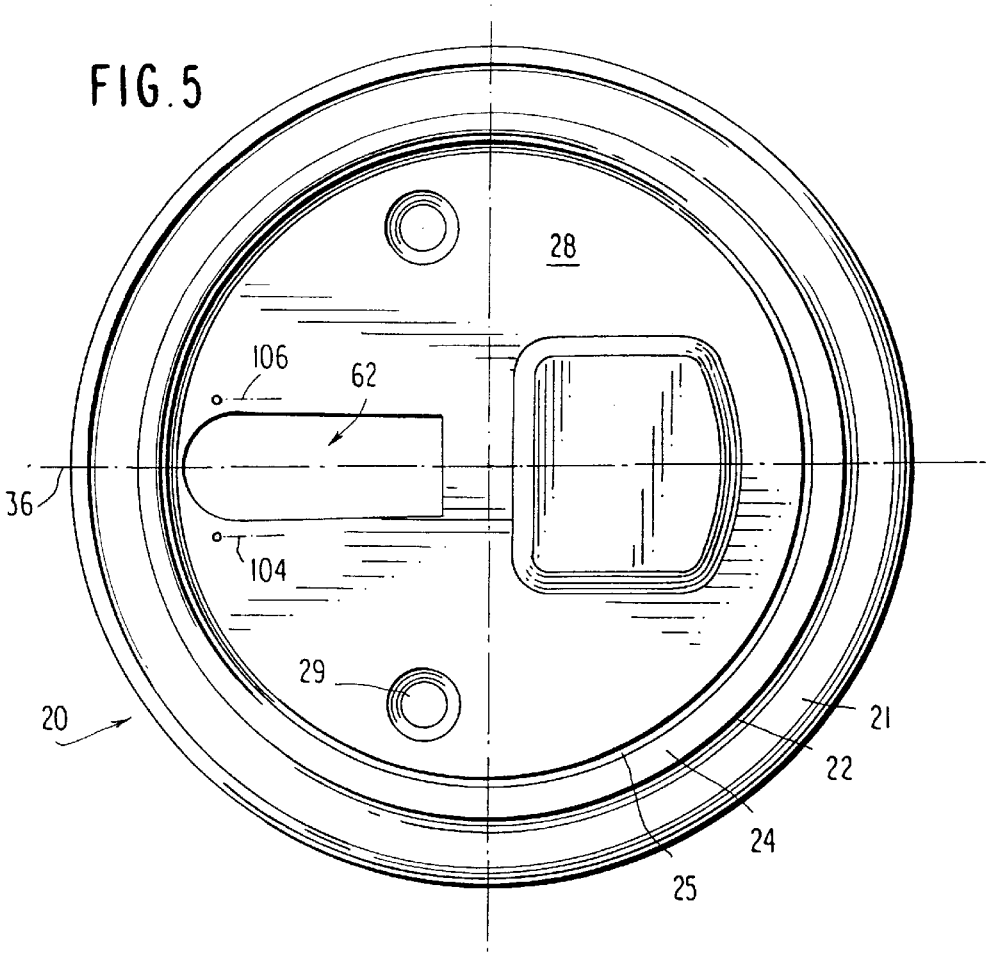
FIG. 5 is a bottom plan view of the embodiment of FIG. 4.
Figure 6:
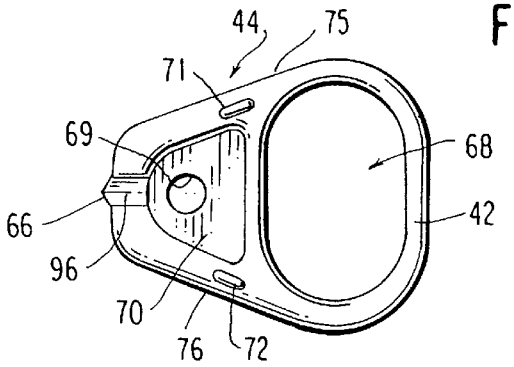
FIG. 6 is a top plan view of the opener to be made integral with the end closure structure of the invention.
Figure 7:
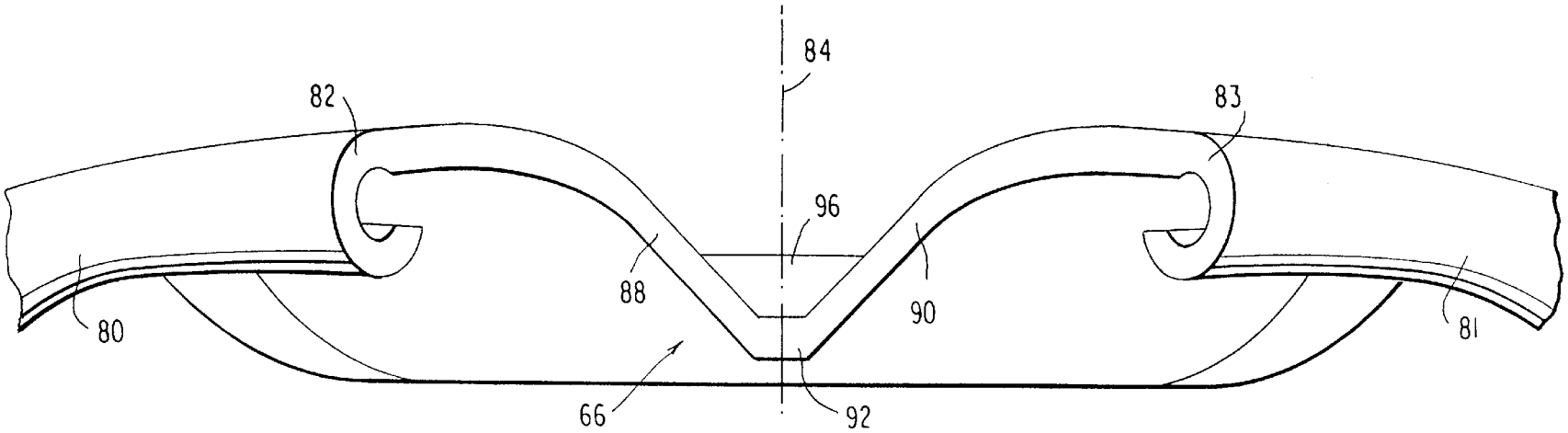
FIG. 7 is an enlarged front elevational view showing the "gull-wing" configuration at the working end of an opener for use in the invention.
Figure 8:
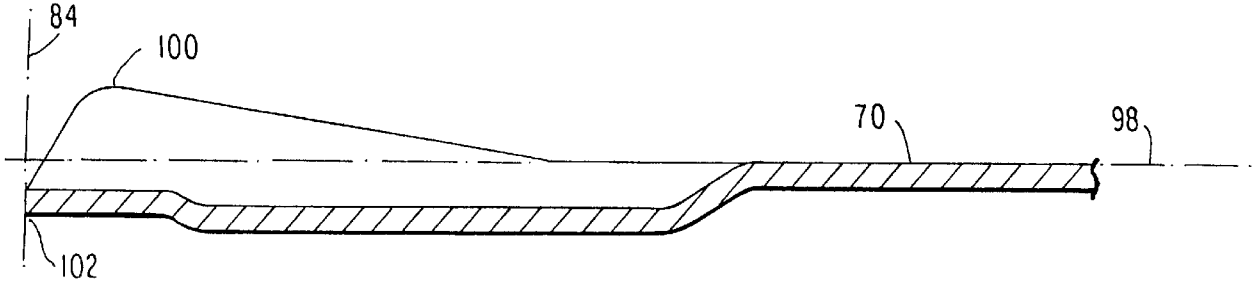
FIG. 8 is a partial side elevation view, partially in section, of such gull-wing portion of the opener shown in FIG. 7.
Figure 9:
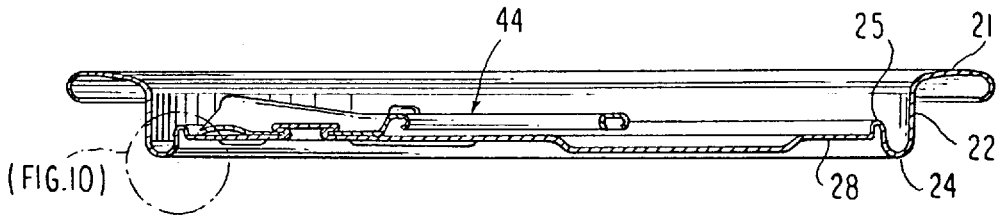
FIG. 9 is a cross-sectional view of the embodiment of FIG. 3 taken along the line 9—9 of FIG. 3.
Figure 10:
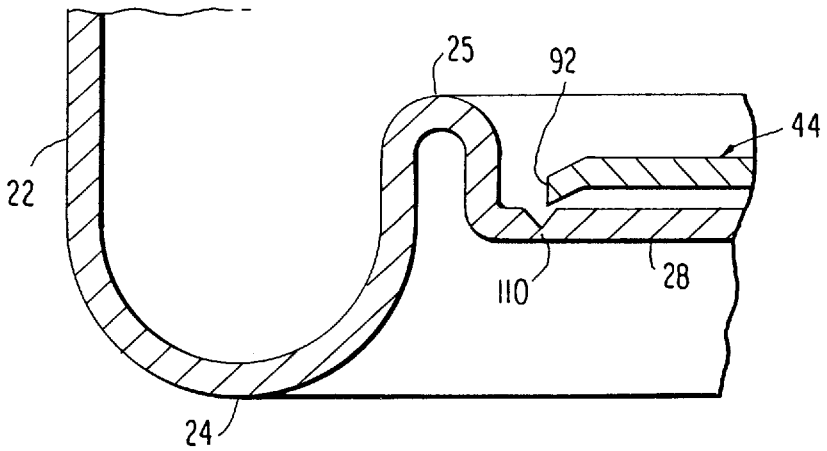
FIG. 10 is an enlarged cross-sectional schematic view of a portion of the endwall cross section of FIG. 9.

Referring to the container end closure structure drawings, in FIG. 1 the opener and means for securing an opener to an endwall panel are omitted in order to better show the inter-relationships of scoreline and profiling features taught by the invention; FIG. 2 is a bottom plan view showing the location for a rivet for holding an opener; FIG. 3 is a top plan view with the opener held in place by a rivet button; FIG. 4 is a top plan of the end closure of FIG. 3 after opening; and, FIG. 5 in the bottom plan view of FIG. 4 showing that the tear strip and opener are stored without interfering with the opening. FIGS. 6 through 8 refer to the opener; and, FIGS. 9, 10 are cross-sectional views relating to FIG. 3.

A flat-rolled sheet metal blank is converted, in part by a shell-forming stage, into an end closure 20. The plan view of FIG. 3 designates the peripheral chime seam metal 21 for end closure 20. A chuck wall 22, a countersunk indentation 24, and protruding bead 25 are better seen in the later cross-sectional views of end closure 20 (FIGS. 9 and 10). Such chuck wall 22, indentation 24 and protruding bead 25 are all symmetrically disposed in relation to the geometric center 26 (FIG. 2) of endwall panel 28.

Chime seam metal 21 circumscribes the centrally located endwall panel 28 which is countersunk (toward the container interior (or product) side of the end closure container structure in relation to the chime seam metal. Chuck wall 22 (as best seen in cross-sectional views of FIGS. 9 and 10) extends between the chime seam metal 21 and countersunk indentation 24; the latter indentation then extends to protrusion bead 25. Both the indentation 24 and protrusion bead 25 are intermediate the chuck wall 22 and endwall panel 28.

During fabrication, a pair of panel protrusions, one of which is designated as 29 in FIG. 1, provide for accurate registration as the sheet metal work product: is moved from station to station during fabrication of easy-access features. After the shell forming stage, the sheet metal of panel 28 (which has a preselected nominal thickness) is scored to provide residual metal of predetermined, decreased thickness(es). Such scoring defines a tear strip 30 (FIGS. 1 and 2) which is to be moved from the substantially planar contour of endwall panel 28 by severing the residual metal of the scoreline means defining the opening. Profiling of endwall panel sheet metal is carried out contemporaneously with scoreline formation and functions to take up excess metal generated by scoring the sheet metal.

In providing a pour opening for a beverage can as shown in FIGS. 1–5, an elongated U-shaped tear strip 30 is defined by scoreline means which include a curvilinear portion 32 (which is arcuate-shaped in plan view) and a pair of elongated scoreline legs 34, 35.

In defining the tear strip, a scoreline leg extends from each end of the arcuate-shaped scoreline 32, the pair of legs are in parallel or slightly converging relationship to central longitudinal axis 36, to provide a narrow-width elongated tear strip 30. The lateral sides of the tear strip extend from the curvilinear closed end (defined by arcuate-shaped scoreline 32) toward the remaining (open) end 38 of the U-shaped configuration. The closed end 32 is contiguous to the periphery of the endwall panel and the open end 38 is contiguous to the geometric center of the illustrated endwall panel.

The scoreline legs 34, 35 are symmetrically disposed in relation to central longitudinal axis 36; and are preferably linear and converge slightly in extending from the arcuate-shaped scoreline 32. Scoreline legs 34, 35 can be parallel but, any substantial divergence is avoided in accordance with present teachings. In the embodiment shown in FIGS. 1, 2, the angle of convergence of each leg is about one degree and fifteen minutes, with a practical combined maximum convergence of about three degrees considering convergence of both legs; such slightly converging legs are referred to as being "substantially parallel." The scoreline legs are preferably rectilinear for fabricating purposes and for tooling preparation purposes; but, slight curvilinearity in configuration could be tolerated if the above-described, narrow-width, symmetrical characteristics for the tear strip which precludes slippage of the tear strip or opener into the container body, and the desired characteristics for the opening, are maintained; also, the lever action and other features, described later, which comprise novel concepts and teachings of the invention must be maintained.

The distal ends of elongated scoreline legs 34, 35 terminate at, and define, such remaining (open) end 38 of the U-shaped configuration; such that, tear strip 30, while being movable from the original contour of the endwall panel 28, remains unitary with the remainder of the endwall panel by means of the transversely located sheet metal at open end 38 (FIG. 2). A recessed portion 40 of endwall panel 28, located beneath handle end 42 of a tab opener 44 (as seen in FIG. 3), facilitates prying access for initiating lifting of handle end 42 in a direction away from the external (or public side) surface of panel 28.

Shallow-depth profiling ribs 46, 47 and 50, 51 (FIG. 2) are located contiguous to the scoreline defining tear strip 30 and serve plural functions. Preferably, the profiling ribs are longitudinally contiguous to and parallel to the scoreline legs; and, can be strategically placed within the scored periphery of tear strip 30 (as shown in the embodiment of FIGS. 1, 2). The location of separate pairs of the profiling ribs 46, 47 and 50, 51 (FIG. 2) help to establish separate longitudinal segments of the tear strip.

A desired folding action for storing longitudinal sections of tear strip 30 in folded overlapping relationship, along with opener 44, within the confines of the chuck wall 22 is shown in plan view in FIG. 4 (the folding action is shown in perspective in later FIGS. 11, 12, 13). The length and disposition of the tear strip, placement of the rivet, and length of the opener are coordinated as taught herein for such interfitting storage purposes.

Referring to FIG. 2, segment 54 of the tear strip is transverse to the central longitudinal axis (36). No longitudinally-extending profiling is in transverse section 54 which allows for placement of a rivet button as shown in FIG. 2 (as well as the rivet head on the exterior). In addition, transverse section 54 helps to provide for folding of a longitudinally distinct closed-end segment and open-end segment of the tear strip. Two such folding segments are formed; the closed-end segment, also referred to as a "nose" segment 55, includes the rivet and is on the initial-rupture, curvilinear end of the U-shaped tear strip. The open end segment 56 comprises the remaining portion of the tear strip extending to the open end of the U-shape at 38. Ribs 46, 47, which can be in a folded "nose" segment, can extend into the semi-circle defined by scoreline 32. Ribs 50 ,51 can be located within the remaining fold segment but extend longitudinally to the vicinity of the distal ends of scoreline legs 34, 35 but do not extend substantially beyond in a manner which would interfere with the folded stored position.

These distinct segments of tear strip 30 are folded over in relation to each other at transverse section 54 during opening, and during storage of the opener and retained tear strip. Results of such coordinated actions, including compact interfitting relationships, are illustrated in a plan view in FIG. 4 and in later enlarged and perspective views of FIGS. 11–13.

Individual profiling ribs 46, 50 are continuous to, and substantially parallel to, scoreline leg 35. In the embodiment illustrated, they are within the periphery of tear strip 30. Individual ribs 47, 51 are contiguous to, and parallel to, scoreline leg 34; and, in the embodiment shown, are within the periphery of tear strip 30. Preferably, the longitudinally extending rib means do not extend beyond the longitudinal ends of the tear strip and do not extend longitudinally across the transverse portions 38 or 54, whether within or without the U-shaped scoreline. Ribs 50, 51 preferably terminate at open end 38; and, whether within or without the tear strip 30, terminate in that manner so as to facilitate folding of the sheet metal (across 38) at such terminating ends of the scoreline legs 34, 35.

Transverse section 54 (FIG. 2) of the tear strip 30 is free of longitudinally-directed ribs and surrounds the unitary rivet button 60. The nose section 55 (circumscribed at least in part by scoreline 32) and the transverse section 54 define a first tear strip segment; a second tear strip segment is started after the rivet button of section 54 and extends toward the remaining open end of the tear strip.

Figure 14:
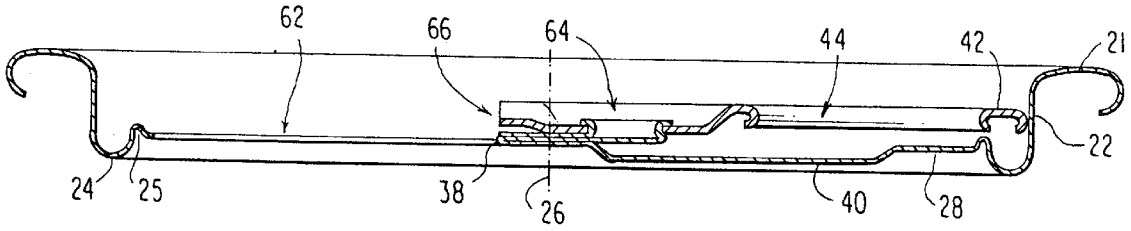
FIG. 14 is a cross-sectional view of the end closure structure of FIG. 4 for showing storage of the tear strip and integral opener on the exterior surface of an endwall closure structure embodiment of the invention.

The segment which includes nose section 55 is folded at transverse section 54 in angled relationship to the second fold segment 56 during the opening and fold back procedure; and, segment 55 overlays the remaining segment 56 as tear strip 30 is stored (FIGS. 4, 14). Opener 44 overlays both folded segments and a panel portion leading to chuck wall 22; neither the retained tear strip nor the opener obstruct pour opening 62 (as seen from the plan views of FIGS. 4, 5 and 14).

Referring to FIG. 3, opener 44 is held integrally with the sheet metal of tear strip 30 by unitary rivet head 60. Working end 66 of opener 44 is in place contiguous to arcuate-shaped scoreline 32; and, handle end 42 overlays recessed panel portion 40 prior to opening.

After opening, such handle end 42 abuts the chuck wall 22 of the end closure (FIG. 4); that is, in the circular embodiment illustrated, such folded disposition of handle 42 is diametrically opposite to that portion of endwall panel 28 at which rupture of the tear strip 30 is initiated.

Referring to the plan view of FIG. 6, sheet metal opener 44 provides gripping means 68 at its handle end 42; such gripping means can be a ring-pull opening or a solid panel. A rivet button aperture 69 is in recessed opener panel 70. Longitudinal strength for an integral opener can be augmented by ribs 71, 72; but, the overall longitudinal and lateral strength of the FIG. 6 opener is, in addition to thickness gage considerations, greatly supplemented by edge curling of the sheet metal. Sheet metal gage for flat roiled steel can generally be in the range of about one-hundred to one-hundred fifty #/bb when edge curling is used in fabricating such an opener. Such edge curling (which tucks the raw edge metal within the curl) extends along lateral sides 75, 76, and handle end 42. In a ring-pull opening model, the internal periphery edge metal of a ring-pull opening 68 is also edge curled.

Curled edge metal along the lateral sides is illustrated at 80 and 82 of FIG. 7. The sheet metal curl terminates contiguous to working end 66 of opener 44 where a "gull-wing" configuration is symmetrical about vertical centerline 84. Each such gull-wing 88, 90 extends from chisel point edge 92 toward lateral side curled edge metal 80, 81, respectively; such gull-wings terminate at pivot-points (curl termination points) 82, 83, respectively.

Such chisel-point and gull-wing configurations are formed subsequently to curling edge metal around substantially the remaining periphery of the opener 44. Movement of metal at the curl-free end 66 to a level below that of the edge curls 80, 81 is carried out by draw tooling to form the centered slot 96 (FIGS. 3, 6 and 7) which extends between the recessed opener panel 70 and the chisel-point 92 which is contiguous to the location where the central longitudinal axis 36 intersects working end 66.

Such relative levels, and other novel features of the "gull-wing" working end 66 for opener 44 are further shown by the partial view of FIG. 8; the level of the recessed opener portion 70 is indicated at 98; the gull-wing upper level is indicated at 100; and, the lower level of the "knife-edge" chisel-point 92 is indicated at 102. For initiating rupture purposes, chisel-point 92 is disposed toward the panel contiguous to the mid-point of scoreline 32.

Referring to the cross-sectional views of FIGS. 9 and 10 (and later FIG. 14), chime seam metal 21 is located at the periphery of the end closure container structure 20 and leads into vertically-oriented chuck wall 22. Chime seam metal 21 extends around the full periphery of the container closure structure 20 with chuck wall 22 extending from chime seam metal 21 in the direction of the interior (or product side) of an end closure container structure; i.e., substantially vertically, as in cross-sectional views of FIGS. 9 and 10 showing chuck wall 22 extending into countersunk indentation 24. That countersunk indentation 24 extends below the horizontal plane of endwall panel 28 and helps to provide panel buckle resistance when the end closure structure is subjected to internal pressure during use on a carbonated beverage can body.

Significant contributions of the present invention involve avoidance of flexing of, or play in, the sheet metal endwall panel as lever-action initial puncture and scoreline rupture are taking place at the closed end of and along the U-shaped scoreline. It has been found that such flexing, that is "play" or "give" in the sheet metal, has a tendency to put scoreline residual sheet metal more under tension for breaking purposes, rather than facilitating puncture rupturing. Breaking such metal against its tensile strength is one of the more difficult ways to rupture sheet metal because of inherent tensile strength characteristics of primary metals, such as steel, used in can manufacture.

In a preferred embodiment, this concept of preventing such flexing of the sheet metal endwall panel is augmented by locating externally projecting bead 25 inboard of, and contiguous to, countersunk indentation 24 (FIG. 10). Force requirements for initial puncture and rupturing are decreased as much as 30% by this feature; such reduction in force requirements is a significant factor in convenience-feature ends especially for small diameter containers.

Projecting bead 25 changes how the sheet metal of panel 28 is presented for opening and how such sheet metal reacts to puncture rupturing under lever action and/or severing if residual scoreline metal is ruptured by a tearing action. Placement of projecting bead 25 makes the endwall sheet metal more rigid so that flexing of the sheet metal contiguous to curvilinear scoreline 32 is substantially eliminated. The prior "give" or "play" in sheet metal panels, which increased the need to "break" the residual metal under tension, is substantially eliminated.

Such rigid presentation of the sheet metal provides rapid lever-action rupture; first by puncturing at the mid-point of scoreline 32, with rivet 64 acting as the fulcrum, and continuing to sever along such arcuate portion of scoreline 32. That initial rupture, with Class I lever action about the rivet as a fulcrum, occurs with a resonating sound because of the rigidity of the sheet metal. The arcuate movement (due to lifting) of the handle end inherently continues so that the Class I lever action promptly becomes a Class II lever action (tearing along scorelines 34, 35) as the pivot point contacts 82, 83 (FIG. 7) of the opener become the fulcrum. The point contacts 82, 83 constitute a moving fulcrum as they move along the edges of opening 62 as indicated by lines 104, 106 of FIGS. 4, 5. Such Class II lever action severance of the scoreline legs occurs in a rapid smooth transition at or about completion of Class I lever-action puncture and rupture of arcuate-shaped scoreline 32 which occurs at about 25° of arcuate movement of the handle end 42 of opener 44. The Class II severance of scoreline legs 34, 35 is completed at an angular movement for opener 44 of about 75°; that is, approaching vertical (perpendicular to the plane of panel 28) orientation for the internal opener.

Because of the rigid characteristics of the sheet metal resulting from impression of projecting bead 25, both such lever actions occur rapidly with resonating sounds from the rigid metal. Opener 44 is about 15 degrees from a vertically upright position as scoreline leg tearing is completed.

Figure 12:
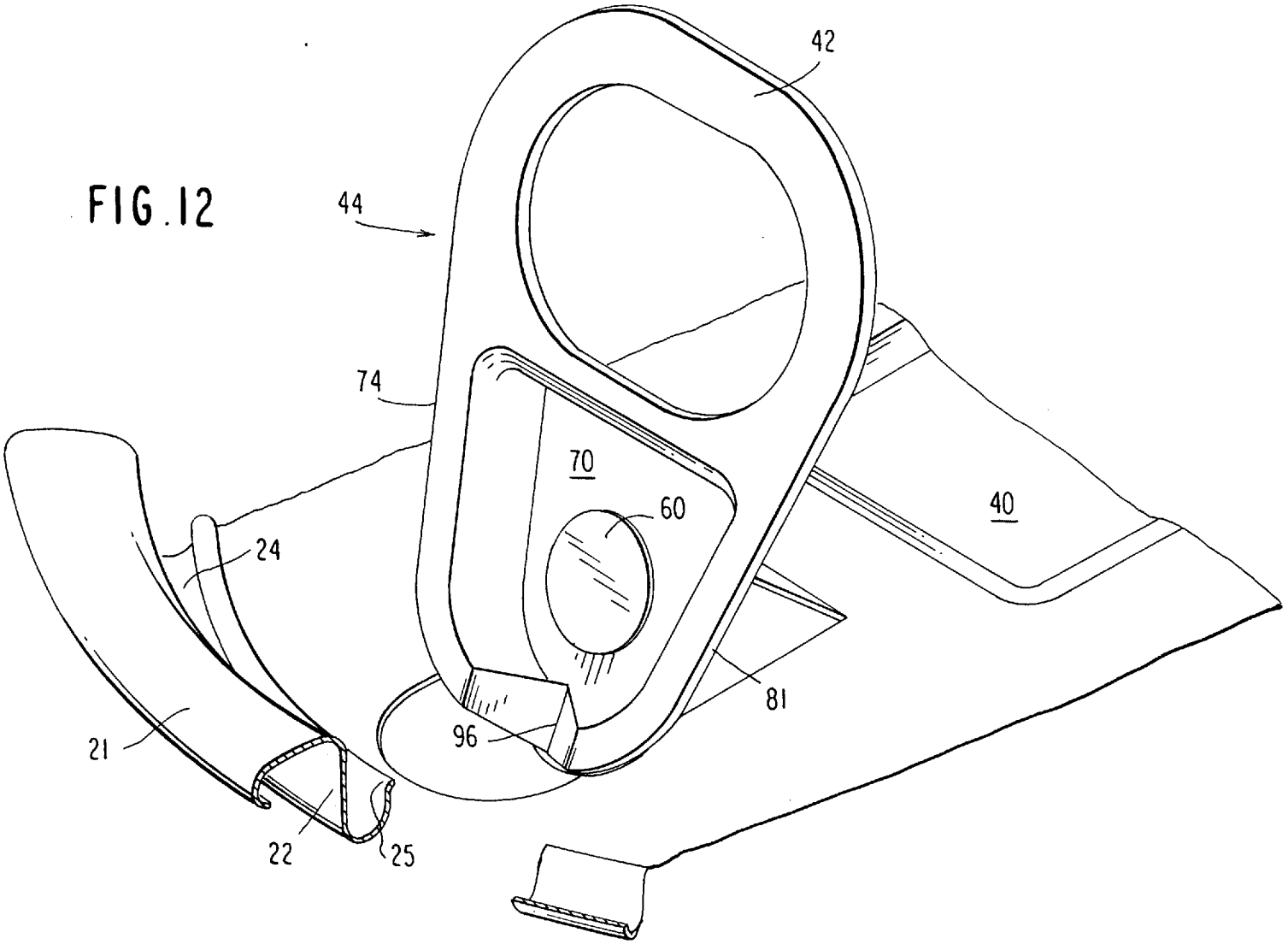
FIG. 12 is an enlarged perspective view for describing a sequential lever-action opening stage subsequent to that of FIG. 11.
Figure 13:
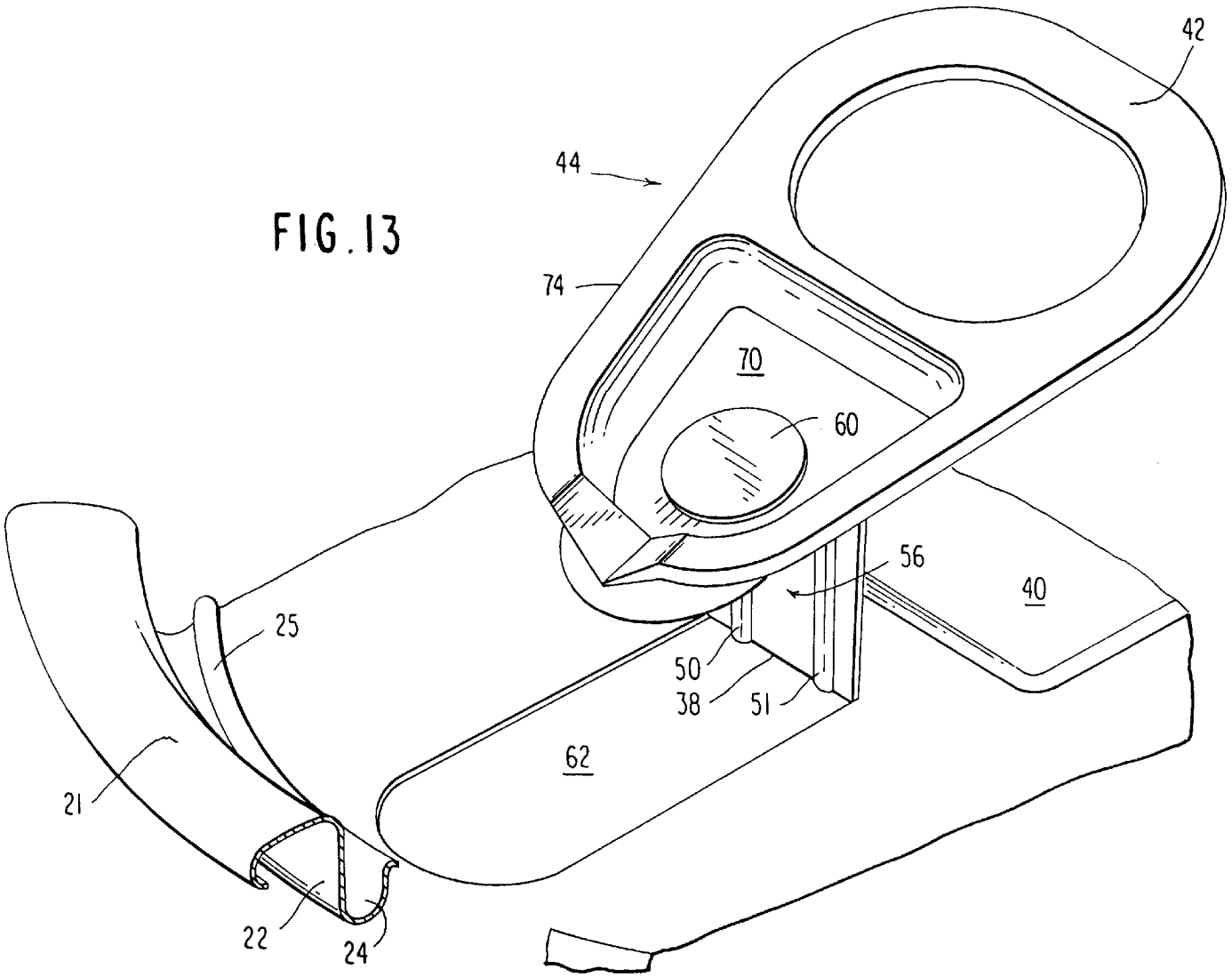
FIG. 13 is an enlarged perspective view for describing an opening stage subsequent to that of FIG. 12.

Handle end 42 of opener 44 is then merely pushed or pulled backwardly in a direction as shown by FIG. 13, toward the positions shown by FIGS. 4, 14, in a plane parallel to endwall panel 28. Both of the fold lines across transverse section 54 in the tear strip and across 38 at the terminal ends of the scoreline legs 34, 35 (FIGS. 1 and 4) were started during the opening procedure so that both folded segments of the tear strip move readily into an overlaying relationship as they are stored, with the opener 44, in parallel relationship to endwall panel 28. Relative positioning before opening shown in FIGS. 9 and 10, followed by the actions shown in FIGS. 11–13, leads to the final stored positioning of FIGS. 4, 14.

Externally projecting bead 25 extends above the level of endwall panel 28 as indicated in FIGS. 9, 10 and 14.

Scoreline residual metal 110 is seen in the enlarged cross section of FIG. 10, which cross section is at the mid-point of arcuate-shaped scoreline 32. The chisel-point 92 is located above such mid-point; gull-wings, as earlier described, lead to the main level of the chisel point 92 from pivot points 82, 83 (FIG. 7).

Figure 11:
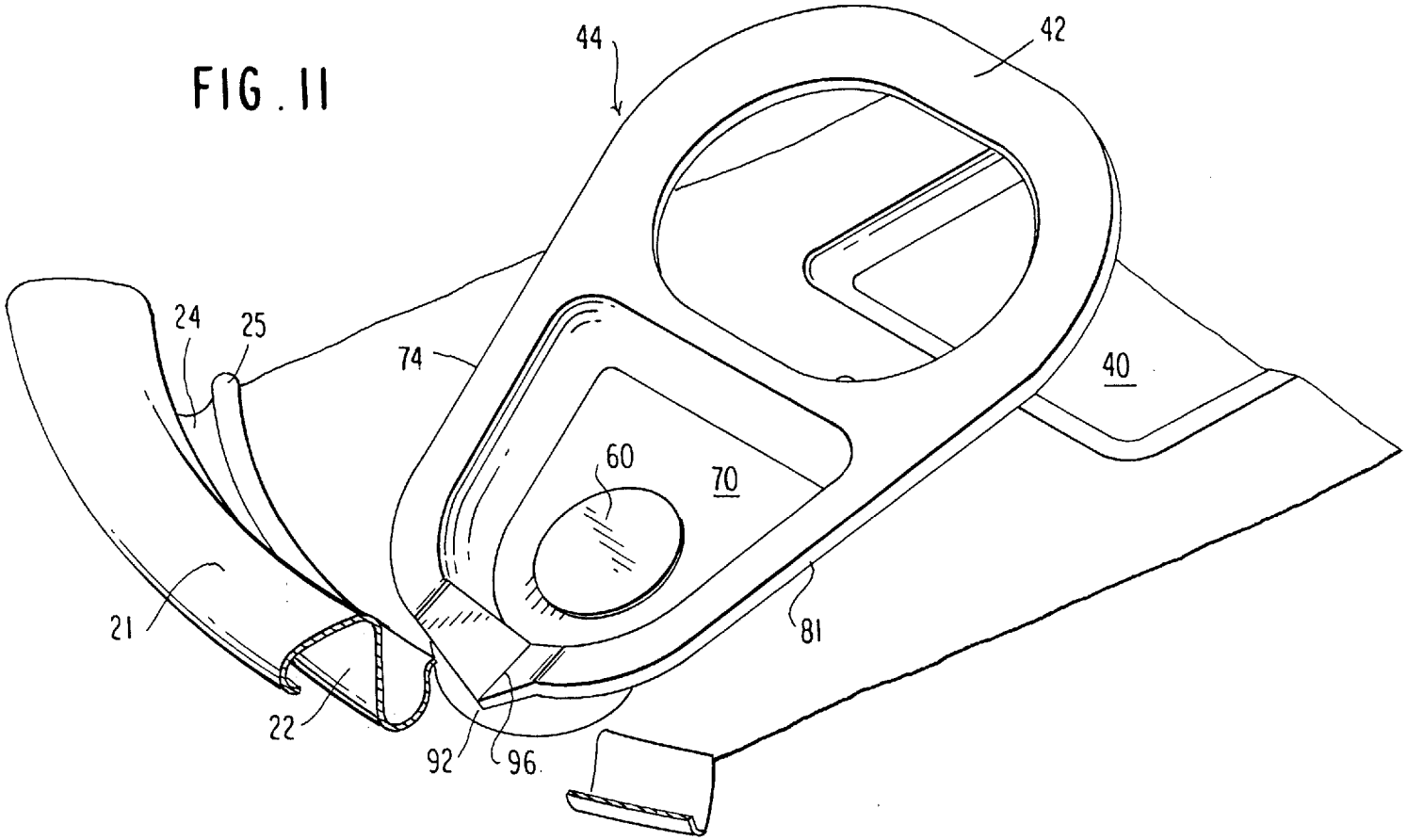
FIG. 11 is an enlarged perspective view of wall and opener portions for describing the initial lever-action rupture of the nose portion of an elongated tear, strip for opening a container in accordance with the invention.

Perspective views FIGS. 11–13 further show the lever-action opening, folding, and storing actions; in FIG. 11 the arcuate-shaped scoreline at the closed end of the U-shaped tear strip is puncture ruptured by Class I lever action of opener 44, the latter moves about rivet 60 as a fulcrum as a result of arcuate movement (through about twenty-five degrees) of handle end 42 in the external direction, away from endwall panel 28.

Arcuate movement of handle end 42 of opener 44 continues toward a more vertically-upright position (included angle between axis of opener 44 and panel 28 of about seventy-five degrees, as shown in FIG. 12), as the straight scoreline leg portions are ruptured by Class II lever action as pivot-point contacts straddle the opening and slide along the rigid panel adjacent to lateral sides at lines 104, 106 (FIG. 4) of the pour opening 62.

With the severing of scored metal of the tear strip as described above, the tear strip folding across transverse sections 54 and 38 has been started during lever-action opening. Opener 44 is then readily moved toward a level in recessed relation to chime seam metal 21. As handle end 42 is moved backwardly toward panel 28, as indicated by FIG. 13, the two longitudinal segments of the tear strip are folded in overlaying relationship when the position of FIGS. 4 and 14 is reached. The opener overlays such segments with each being substantially parallel to endwall panel 28. Handle end 42 fits within the chuck wall 22 as shown in FIGS. 4 and 14. To achieve such an interfitting relationship, the length of the opener 44 is coordinated with the length of the tear strip 30, positions of the rivet 62 and rivet aperture 69, and the inter-folding relationship of the tear strip segments are coordinated, along with other factors, such as shell forming dimensions in a circular end closure which contribute to achieving a workable easy-access structure.

In a workable flat rolled steel embodiment for a 202 (2 2/16" diameter) can body, having a necked-in 201 (2 1/16") open end, the following dimensions are typical:

| ITEM | DIAMETER |
|---|---|
| Chime metal 21 (outer periphery) | 2.310" |
| Chuck wall 22 | 1.962" |
| Countersunk indentation 24* | 1.868" |
| Projecting bead 25* | 1.764" |
| (Diameter as indicated for the indentation 24 and bead 25 is measured at the cross-sectional center of each, as viewed in FIG. 9 | |
| | **RADIAL LENGTH** |
| Tear strip | .715" |
| Geometric center of rivet 60 to opener end 6.6 (FIG. 3) | .292" |
| Geometric center of panel 28 to working end 66 of opener 44 (FIG. 3) | . 830" |
| Geometric center of panel 28 to handle end 42 of opener 44 (FIG. 3) | .270" |
| Tear strip segment 55 (including rivet section 54 | .355" |

-continued

| ITEM | |
|---|---|
| at closed end of U-shape (FIG. 2) | |
| Tear strip segment 56 at open end of U-shape (FIG. 2) | .360" |
| Countersunk indentation 24, radius | about .037" |
| Projecting bead 25, radius | about .007" |
| Scoreline 32, radius | about .156" |
| | **HEIGHT** |
| Level of chime seam metal 21 to level of endwall panel 28 | .168" |
| Level of chime seam metal 21 to bottom of countersunk indentation 24 (FIGS. 9, 14) | .212" |
| Profiling ribs (contiguous to tear strip) | (about) .007" |
| Projecting bead 25 (above panel 28) | (about) .018" |
| Countersunk indentation 24 (below endwall panel 28) | (about) .037" |

Typical flat rolled steel gages for such end closure container structure are about seventy-five and one-hundred ten lbs/bb with residual metal of the tear strip scoreline means being between about 0.001" and 0.0035". In a specific embodiment of the above example, 0.008" gage sheet metal was used; residual metal measured 0.0009" at scoreline 32, and residual metal was measured up to 0.0016" along scoreline legs 34, 35; such specific embodiment for a 202 can body withstood nominal one-hundred psi internal pressure without leakage or bursting along such tear strip scorelines.

The preferred flat rolled steel substrate for end closure container structures comestibles is electrolytically treated on both substrate surfaces; for example, electrolytic application of a metallic coating, such as chrome oxide or chrome and chrome oxide, which acts as a surfactant to facilitate adhesion, on each such surface, of an organic polymeric coating with lubricant (both the organic coating and lubricant must be approved by the U.S. Food and Drug Administration for use with products for human consumption).

Typical flat rolled aluminum substrates are in the range of about 0.012" to about 0.015" with residual scoreline metal of about 0.004" to about 0.008".

Figure 15:
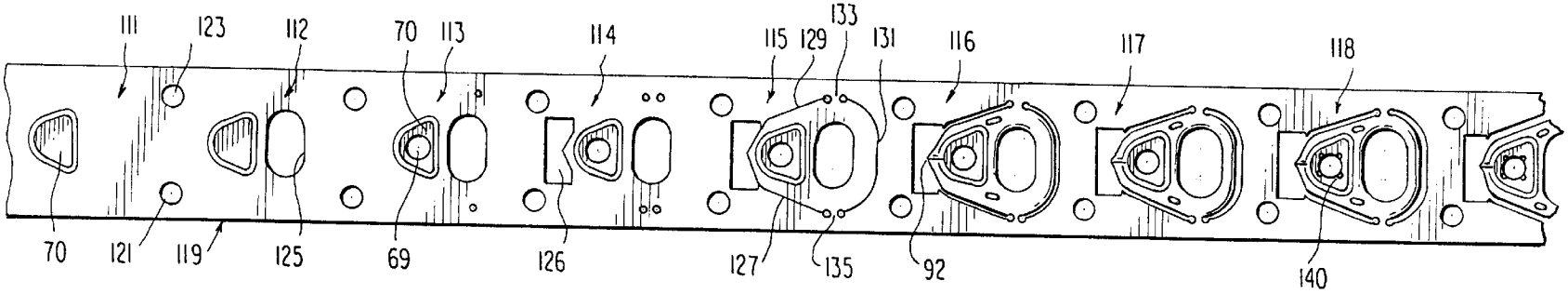
FIG. 15 is a top plan view of an elongated unitary sheet metal strip showing the progression of sequential fabricating stages for the new configuration opener of the invention.

Special features of sheet metal opener 44 are achieved by a progression of fabricating stages, numbered 111 through 118 in FIG. 15, which are carried out on an elongated sheet metal strip 119. Initially, registration holes 121, 123 are punched out of the strip using punch and die tooling and opener panel 70 (shown in FIG. 6) is shaped by draw process tooling in first stage 111. In the progression illustrated, conventional punch and die operations can be used for punching out portions of the sheet metal; and, conventional draw processing operations can be used; of course, opposing tooling members of each are designed to provide the shaping taught by the invention.

The next sequential stage 112 comprises punching out opening 125 which is a preforming step in providing a ring pull. In stage 113, rivet button opening 69 (FIG. 6) is punched out of panel 70 followed by punch-out of a "bat-winged" configuration opening 126 in stage 114. Such angled "bat-wing" edges define working end 66 metal edge portions which will be formed into chisel-point 92 and gull-wings 88, 90 (FIG. 7).

In stage 115, cut lines 127, 129 for preforming lateral sides 75, 76 of opener 44 are made; and, curvilinear cut line 131 is made for preforming of the handle end 42 of opener 44 (shown in FIG. 6). The resulting partially precut work product for opener 44 of stage 115 remains part of strip 120 by means of unitary connector joints 133, 135 (between small diameter punch holes), which hold the work product through remaining stages for completion or near-completion (as selected) of opener 44 in a progression of stages while part of elongated strip 119.

Edge metal rolls 80, 81 (FIG. 7) along lateral sides 75, 76 are formed by progressively curling of edge metal in stages (116 and 117 as shown in FIG. 15). The edge metal is also curled for handle end 42; and curled metal extends around the internal periphery (of opening 68 in FIG. 6) in a ring-pull embodiment. Connector joints 133, 135 (stage 117 and the following stages of FIG. 15) hold the work product for such progressive stages. Edge curling, in which raw edge metal is tucked on the inside of the curl, is known commercially.

Further shaping operations for the opener are carried out in 115 through 118 (FIG. 15—while in strip form) in addition to edge curling. For example, draw process placement of the chisel-point is initiated in stage 116; and/or other steps such as forming four-pronged "rosette" 140 about opening 70 can be carried out in stage 118.

Placing an upward tilt on handle end 42; that is, in a direction away from the external surface of the end closure when the opener is made integral with the end closure, can be carried out in strip form or subsequently; use of such a handle tilt may be dependent on the type of finger access profiling provided for panel 28.

Draw processing to shape working end 66 (FIG. 6) is initiated in stage 116 (FIG. 15) and is completed in the progression; or, can be completed separately to form gull-wings 88, 90 and position a chisel-point 92, as shown in FIGS. 7 and 8, to facilitate initial rupturing operations.

As seen in FIG. 7, knife-edge chisel-point 92 is located at the culmination of gull-wings 88, 90 at a level toward the panel and scoreline to be severed and spaced from the edge metal pivot points 82, 83. Such placement of the chisel point 92 toward the panel (below the level indicated at 96 of FIG. 7) is completed using draw forming tooling.

Scale dimensions for an opener suitable for the above end closure embodiment for a 202 can body are approximately as follows:

Longitudinal length from working end 66 to handle end 42 1.10"

FROM KNIFE EDGE 92:

Longitudinally:

to start of recessed panel 70 0.12"

to geometric center of opening 69 0.26"

to the inner curled edge of ring area 68 0.55"

WIDTH:

at pivot points 82, 83 0.35"

at widest dimension for ring area 68 0.90"

SUBSTRATE:

Flat rolled steel, gage 110 to 155 #/bb

As pointed out earlier, the opener 44 can be pushed or pulled into stored position. For one-handed operation, opener 44 would maintain the solid panel (free of a ring area opening) presented in stage 111 of FIG. 15 by omitting the ring-pull punch out at 125 of stage 112.

Specific materials, dimensions, and configurations have been set forth for purposes of describing a specific embodiment of the invention. However, in the light of such teachings, other sizes, configurations and/or dispositions can be devised while still relying on and utilizing novel concepts of the invention; therefore, for purposes of determining the scope of the present invention, reference shall be made to the appended claims.

It is claimed:

1. A sheet metal end closure, with an integral opener, for a beverage can body, comprising A. an endwall panel of substantially planar contour, forming part of B. unitary end closure structure for a beverage can body fabricated from predetermined nominal thickness gauge sheet metal, in which such end closure structure includes (i) chime seam metal symmetrically spaced from the geometric center and disposed to peripherally circumscribe such entire endwall panel, with such endwall panel being recessed symmetrically from such chime seam metal in an axial direction so as to be disposed, during use, toward the interior of such a beverage can body, (ii) a chuck wall extending in such axial direction from such chime seam metal to a level axially interior of such endwall panel so as to define, with such unitary end closure structure sheet metal, a countersunk indentation recessed axially toward the interior of such a can body so as to provide buckle-resistance for such end closure structure peripherally circumscribing such entire endwall panel, (iii) a bead projecting from such endwall panel, in an external direction in relation to such a can body, toward the geometric center of such endwall panel, located contiguous to such buckle-resistant profiling, and with such bead, as projecting externally from such endwall panel, substantially eliminating flexing of endwall panel sheet metal contiguous to such externally projecting bead;

C. a scoreline, formed on such external surface of such endwall panel, having an elongated U-shaped configuration defining a tear strip for providing a pour-feature opening in such endwall panel, such tear strip scoreline consisting essentially of endwall panel sheet metal of decreased thickness in relation to such nominal thickness gauge, with such scoreline being symmetrically disposed in relation to a centrally-located elongated axis of such U-shaped configuration;

D. an elongated sheet metal opener for severing residual metal of such tear strip scoreline so as to enable sheet metal of such tear strip to be moved externally from such substantially planar endwall panel so as to provide a pour-feature opening while retaining such tear strip on such endwall panel; with such elongated sheet metal opener being symmetrically disposed in relation to a centrally-located elongated axis for such opener and having a working end and a handle end, with each such end being located at a longitudinally opposite end of such axis;

E. unitary rivet means formed from endwall panel sheet metal, located within such tear strip scoreline, securing such elongated opener so as to be retained by such elongated U-shaped tear strip, with such centrally-located elongated axis of such opener overlaying, prior to severing such residual metal of such tear strip, and extending in the same direction as, the centrally-located longitudinal axis of such U-shaped tear strip, so as to enable such tear strip to be moved, by such opener, from such substantially planar contour of such endwall panel to provide a pour-opening; and, in which such U-shaped tear strip scoreline includes (iv) an arcuate shape defining a closed longitudinal end for such elongated U-shaped scoreline, and (v) a pair of elongated scoreline legs, each extending from such arcuate shape, in laterally-spaced relationship, toward the remaining longitudinal end of such elongated tear strip scoreline which retains such tear strip, and such rivet-secured opener, externally on such endwall panel, with such centrally-located longitudinal axis of the elongated tear strip intersecting such arcuate-shaped scoreline portion at its midpoint, and such midpoint being positioned contiguous to such endwall projecting bead, which substantially eliminates flexing of sheet metal circumscribing such endwall panel so as to facilitate initiating puncturing rupture of such endwall panel residual scoreline sheet metal, and to provide for movement of sheet metal within such tear strip scoreline from such substantially-planar endwall panel so as to be retained, with such rivet-secured opener, externally on such closure structure at a location free of obstruction to such pour-feature opening.

2. The structure of claim 1, in which each of such pair of scoreline legs is spaced laterally from such tear strip central longitudinal axis, with the major directional component of such legs being selected from the group consisting of (a) substantially parallel to the centrally-located longitudinal axis of such tear strip, and (b) converging slightly toward such centrally-located longitudinal axis at an angle about one and a half degrees for each such leg in extending from the arcuate-shaped scoreline portion.

3. The structure of claim 1, in which such elongated rivet-secured opener includes a contact edge at its working end for initiating puncturing rupture of such arcuate-shape scoreline portion, such contact edge of the opener being positioned by such rivet means, contiguous to such mid-point of the arcuate-shaped scoreline portion, so as to be in a position to rupture such closed end of the U-shaped scoreline by Class I lever action, upon arcuate movement, about such rivet means as a fulcrum, as such handle end of such elongated opener is lifted in an external direction in relation to such beverage can body, when such end closure structure is in use on such can body.

4. The structure of claim 3, in which the elongated leg portions of the tear strip scoreline, for movement of such tear strip from such endwall panel, are at least partially severed along their length, after such Class I lever action initial puncturing rupture of the arcuate-shaped scoreline residual metal, by Class II lever action, as such arcuate movement of the handle end of such opener is continued in the same direction as that for such initial rupture.

5. The structure of claim 3, in which the elongated opener further includes a pair of pivot point contacts located in longitudinally recessed relationship to the initial-contact working edge of such opener, with each of the pivot point contacts being disposed on a respective side of the opener in laterally spaced relationship from the central longitudinal axis of the axis, and in which the tear strip scoreline is further severed, after such initial Class I lever puncturing rupture, by pivoting such opener about such pivot point contacts, with one each in contact with end wall panel sheet metal on each lateral side of such elongated tear strip, with such further severance extending along such elongated scoreline legs and being carried out by Class II lever action, with the pivot point contacts acting as the fulcrum for such Class II lever action as movement of the handle end of the tab opener is continued in the same direction as such Class I initial puncturing rupture.

6. The structure of claim 5, in which such elongated tear strip and opener are retained on the external surface of such end closure, when rupturing of the scoreline legs is completed, with such opener being in substantially parallel relationship to such substantially planar endwall panel at a location which is longitudinally opposite to the position of such opener, in relation to such tear strip, prior to start of rupture of such arcuate-shaped portion of such tear strip scoreline.

7. The structure of claim 6, in which such endwall panel has a circular configuration in plan view, and in which, after opening of such pour-feature tear strip, such opener is disposed in parallel relationship to a remaining portion of such substantially planar endwall panel, with a pair of longitudinally-extending segments of such movable tear strip being in overlaying relationship to each other and such remaining portion of such substantially planar endwall panel, such opener being located diametrically opposite, on such endwall panel, to its location prior to such initial rupture of such tear strip scoreline, with such handle end of such opener being located geometrically within such chuck wall.

8. The structure of claim 1, in which sheet metal of such unitary endwall closure structure is selected from the group consisting of flat-rolled steel substrate in the range of about 75#/bb to about 110#/bb, with residual metal of such scoreline means having a thickness in the range of about 0.001" to about 0.0035", and flat-rolled aluminum substrate having a thickness gage of about 0.010" to 0.015", with residual metal of such tear strip scoreline having a thickness in the range of about 0.0040" to about 0.0055".

* * * * *